United States Patent [19]

Hirai

[11] 4,022,011

[45] May 10, 1977

[54] YARN PIECING METHOD FOR OPEN-END SPINNING MACHINE

[76] Inventor: Hironori Hirai, 8-1, Kaidenhigashi-Tsukamoto, Nagaokakyoshi, Kyoto, Japan

[22] Filed: Feb. 10, 1975

[21] Appl. No.: 548,728

[30] Foreign Application Priority Data

| | | |
|---|---|---|
| Feb. 14, 1974 | Japan | 49-18360 |
| Feb. 13, 1974 | Japan | 49-18066[U] |
| Apr. 15, 1974 | Japan | 49-42689[U] |

[52] U.S. Cl. ..... 57/156; 57/58.95

[51] Int. Cl.[2] ..... D01H 15/00

[58] Field of Search ..... 57/58.89–58.95, 57/156, 34 R

[56] References Cited

UNITED STATES PATENTS

| | | | |
|---|---|---|---|
| 3,455,095 | 7/1969 | Makeham et al. | 57/58.89 X |
| 3,524,312 | 8/1970 | Landwehrkamp et al. | 57/58.89 X |
| 3,541,774 | 11/1970 | Sterba et al. | 57/58.95 X |
| 3,597,911 | 8/1971 | Schiltknecht | 57/58.89 X |
| 3,662,532 | 5/1972 | Stahlecker | 57/58.89 |
| 3,810,352 | 5/1974 | Miyazaki et al. | 57/58.95 X |

*Primary Examiner*—Richard C. Queisser
*Assistant Examiner*—Charles Gorenstein
*Attorney, Agent, or Firm*—Whittemore, Hulbert & Belknap

[57] ABSTRACT

The invention relates to a yarn piecing method and apparatus for an open-end spinning machine. According to the method of the present invention, the rotor is braked when the yarn breaks for reducing its rotational speed, while the feed roll which has stopped its rotation is rotated for a short time, so that the fiber of short length unfit for yarn piecing is supplied into the rotor. The supplied fiber is discharged from the rotor, with dust and dirt collected inside the rotor, by a jet of compressed air supplied from an air compressor. The braking force applied to the rotor is then released and the end of the sliver is supplied into the rotor as the latter is accelerated to a number of revolutions suited for yarn piecing. Then, the yarn take-up operation is started again and the speed of the rotor and that of the package are increased to those corresponding with the normal spinning.

3 Claims, 9 Drawing Figures

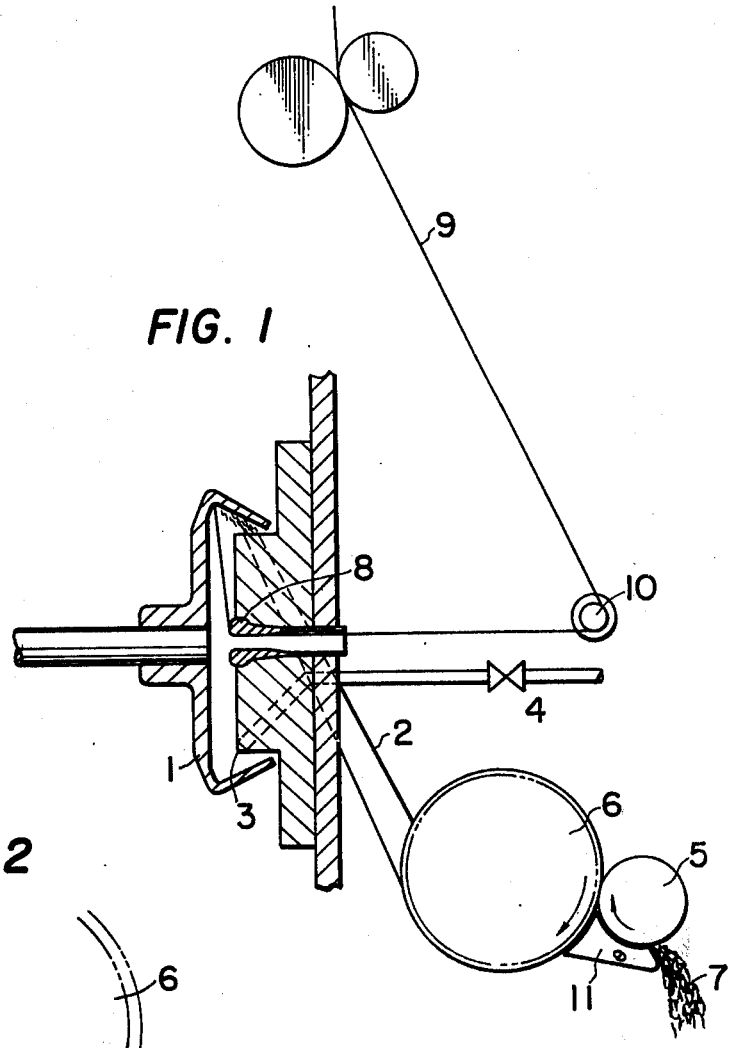
FIG. 1
FIG. 2
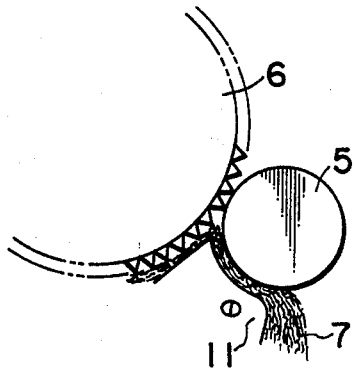

YARN PIECING METHOD FOR OPEN-END SPINNING MACHINE

SUMMARY AND BACKGROUND OF THE INVENTION

The present invention relates to a yarn piecing method and apparatus for an open-end spinning machine wherein the piecing of the broken yarn end and the restarting of the take-up operation are carried out separately at each spinning unit of the spinning machine without affecting the operation at the other spinning units.

In the open-end spinning machine, the yarn package, the rotor and the feed roll of a spinning unit can be stopped and started again individually in case of the interruption of the spinning operation of the spinning unit. However, the combing roll of the spinning unit is adapted usually to rotate continuously at its working speed of rotation.

If the yarn should break or the yarn package is completely formed, the rotation of the feed roll is stopped, but the combing roll continues to rotate until the broken yarn end is pieced to the fiber by the operator or by the operation of the travelling joining unit. Thus the end of the sliver resting on the feed roll will be opened or broken continuously by the rotating combing roll, and the fiber thus opened is supplied into the rotor with rotation of the combing roll. This fiber has a density and length different to a marked degree from those of the fiber supplied into the rotor during normal spinning. When the yarn should break simultaneously in a plurality of spinning units, the fiber will be worsened further in its length or density since it will take some time until the yarn end is pieced to the fiber. Thus the subsequent yarn piecing will result in failure or formation of an uneven joint in the spun yarn.

It is, therefore, a primary object of the present invention to provide a yarn piecing method wherein the feed roll is rotated for a short time at the time of yarn piecing for delivery of the end of the sliver into the rotor, and the end of the sliver thus supplied is removed from the inside of the rotor, the feed roll being then driven again into rotation for delivery of new fiber to be pieced with the end of the broken yarn.

It is a second object of the present invention to provide a method for cleaning the rotor that will enable a prompt yarn piecing after completion of the cleaning of the rotor. Injection of compressed air into the rotor is convenient in that the cleaning operation may be carried out with the rotor being closed. The present inventors have found that, when the compressed air is injected into the rotor while the latter is rotating slowly, the waste fiber and other impurities that are collected on the inner wall of the rotor may be carried away efficiently by the compressed air. According to the present invention, the braking device for the rotor is actuated in timed relation with the operation of the injection device, and the feed roll is driven in rotation transiently during low-speed rotation of the rotor caused by the actuation of the braking device. The fiber broken from the end of the sliver may thus be discharged from the rotor by the compressed air stream with the dust and dirt collected on the inner wall surface of the rotor. Thereafter, the supply of compressed air is discontinued, while the rotor is released from brake application and accelerated to its working speed of rotation. The various devices are connected operatively with one another for positively cleaning the inside of the rotor in a short period of time. Moreover, this method gives rise to a further advantage. The operation of yarn piecing may be carried out most effectively at the r.p.m. of the rotor equal to 30,000 whereas the number of revolutions of the rotor during normal spinning amounts to about 60,000 r.p.m. Thus the yarn piecing can be carried out at the optimum r.p.m. in the course of accleration of the rotor, the latter being then accelerated to its working speed of rotation after the fiber is pieced successfully to the broken yarn end. It should be noted however that the delivery device adapted for positively withdrawing the yarn from the rotor is rotated at its working speed of rotation as the combing roll. The take-up package is accelerated in correspondence with the acceleration of the rotor. If the yarn should be gripped by the delivery device while the rotor has not attained its working speed, an operative relation between the speed of the take-up package and that of the rotor will be affected adversely thus giving rise to the yarn defect or breakage, as the case may be.

It is the third object of the present invention to get the yarn travel sidewise of the delivery device during acceleration of the rotor and to transfer the yarn into the delivery device when the rotor has attained its working ssped of rotation.

To this effect, a threaded roll is mounted in a cantilever fashion to the machine frame in the vicinity of the friction roller of the take-up means. During acceleration of the rotor, the yarn is engaged with the thread formed on the threaded roll and thus kept from being engaged with the traverse guide. This threaded roll is so arranged that, when the yarn has been shifted to the free end face of the threaded roll, it may be brought substantially in contact with the end face of the nip roll which is kept in pressure engagement with the delivery roll. Thus as soon as the yarn is disengaged from the end face of the threaded roll and gripped by the traverse means, the yarn is gripped by and between the nip roll and the delivery roll.

The present invention is applicable most advantageously to a yarn piecing system wherein a yarn piecing unit is provided so as to travel along the front sides of a number of juxtaposed spinning units for detecting the unit or units where yarn break has occurred and automatically piecing the broken yarn in such unit or units without interrupting the continuity in the spinning operation at the remaining spinning units.

BRIEF DESCRIPTION OF THE DRAWINGS

FIG. 1 is a schematic side elevation, partly in section, of a typical open-end spinning machine to which the method of the present invention is applied;

FIG. 2 is an explanatory view showing a portion of the open-end spinning machine shown in FIG. 1;

DETAILED DESCRIPTION OF THE INVENTION

Figure 3:
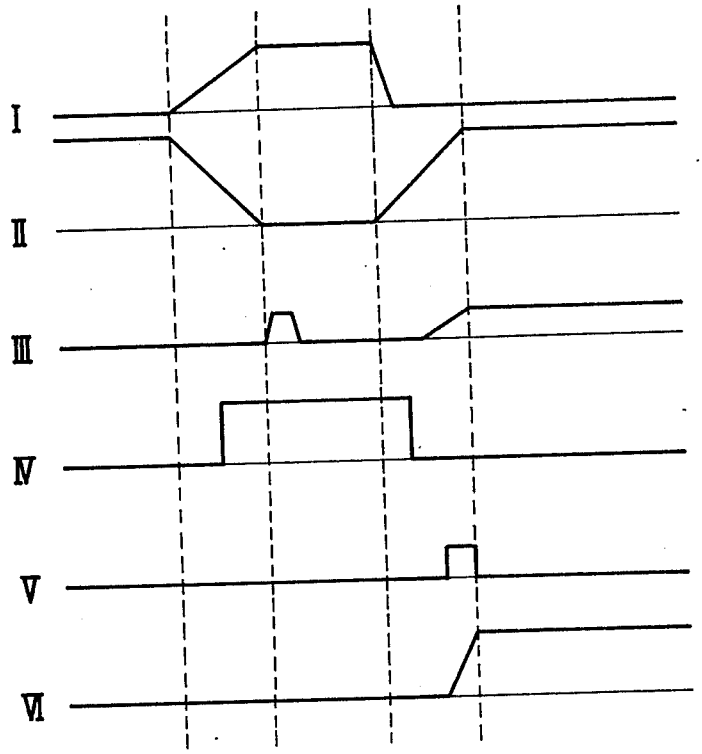
FIG. 3 is a diagram showing the operating phases of the various devices of the open-end spinning machine.

Referring now to the drawings, FIG. 1 shows the essential parts of a typical open-end spinning machine to which the inventive method is applied and which comprises a rotating spinning chamber or rotor 1, a inlet duct 2 for supplying the fiber into the rotor 1, a jet orifice 3 for compressed air, a change-over valve 4 for compressed air, a feed roll 5 for feeding the sliver 7 and an opening roller 6, as conventionally. A bush or navel shown at 8 is preferably of a novel configuration, but the conventional navels may also be used. The thread 9 is spun as it is withdrawn from the rotor 1 by way of the navel 8 and the roller 6. The opening roller 6 is rotated permanently without regard to the occurrence of yarn break in the respective spinning units. When the yarn should break at any spinning unit, the feed roller 5 associated with the unit is brought simultaneously to a stop. At this time, the rotor associated with such unit may also be stopped in its operation until the time of yarn joining operation, or it may continue to rotate without regard to the occurrence of yarn breaks and be braked in rotation only during yarn joining. Thus the number of revolutions of the rotor may be reduced to an optimum value for yarn joining.

The opening roller 6 and the feed roller 5 are shown to an enlarged scale in FIG. 2. The supply of sliver 7 is stopped with cessation of rotation of the feed roller 5, but the end of the sliver 7 gripped between the feed roll 5 and a thread retaining member 11 will be caught by the opening roll 6 which is rotated continuously. The waste fiber thus caught by the opening roll is fed into the rotor 1 by way of the fiber inlet duct 2. This waste fiber is collected inside the rotor because the thread has broken. The impending yarn joining is affected considerably by the presence of such waste fiber, as noted hereinabove. Such waste fiber can be removed by supplying a jet of compressed air into the rotor. At this time, however, the end part of the sliver 7 is reduced in its fiber length because of the breaking action of the opening roller. It may thus be feared that, when such shorter fiber is fed into the rotor upon starting the rotation of the feed roll, the yarn piecing may result in a failure.

The novel method according to this invention will now be described by referring to FIG. 3 illustrating the operative phases of the various parts or devices of the spinning machine. In FIG. 3, I denotes a braking device, II the rotor, III the feed roller, IV the compressor, V an end yarn supply device and VI a wind-up device. As shown in FIG. 3, the rotor associated with the spinning unit where the yarn break has occurred is stopped at the time of yarn piecing by the operation of the braking device. As the rotor is brought to a stop, the feed roller 5 is rotated for a short interval of time for supplying the short length fiber of the end of the sliver into the rotor. The compressor is operated at this time for removing the waste fiber and the short length fiber from the inside of the rotor. The braking device for the rotor is then turned off. When the number of revolutions of the rotor has attained a value suited for yarn joining, the feed roller 5 is operated again. Then, the end yarn is thrown into the rotor for yarn piecing. Upon completion of yarn piecing, the take-up operation is started again so as to resume the normal spinning operation.

According to the novel method of the present invention, the short length fibers at the end part of the sliver are removed in advance of the yarn piecing. Thus the optimum joint may be obtained with a higher rate of success in yarn joining in case of a multispindle spinning machine where the operator may be required to join the broken yarn at some end unit and then at some other unit remote from said end unit.

In the above method, it is known to use a cleaning device in which a jet of compressed air is supplied into the rotor for removal of the remaining sliver. The present inventors have found that the good cleaning effect is not expected when the rotor is stopped or rotated positively and that the optimum cleaning effect may be obtained when the compressed air is supplied while the rotor rotates slowly. FIG. 3 shows typical open-end spinning machine to which the method of the present invention may be applied. In the below, a rotor braking means and a control device for supplying the compressed air during low-speed rotation of the rotor will be explained by referring to FIG. 4.

Figure 4:
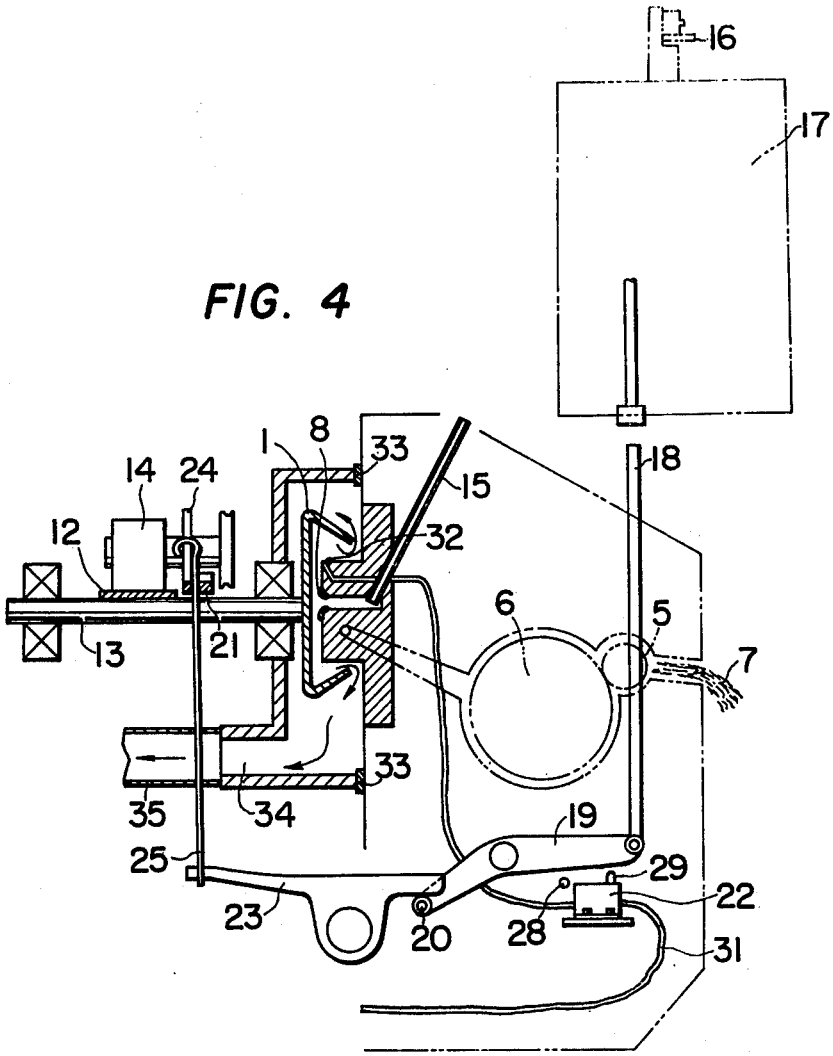
FIG. 4 is a schematic side elevation, partly in section, of a modified open-end spinning machine according to the present invention.
Figure 5:
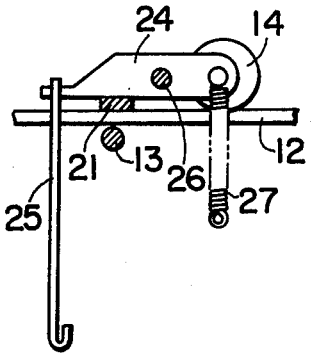
FIG. 5 is an explanatory view showing the braking device for the rotor.
Figure 6:
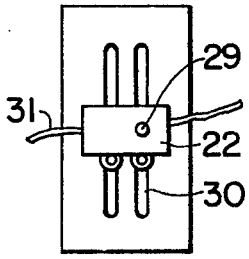
FIG. 6 is an explanatory plan view of the changeover valve means used in the open-end spinning machine shown in FIG. 4.

In FIGS. 4, 5 and 6, the sliver 7 is supplied as fiber into the rotor 1 by way of the feed roller 5 and the opening roller 6. A tension pulley 14 is urged by a spring 27 into contact with a belt 12 which in turn presses a rotor shaft 13, as will be described hereinafter, so that the rotor is rotated while the spring 27 acts on the tension pulley 14. The thread is spun by rotation of the rotor 1 and withdrawn by a take-up mechanism, not shown, by way of the navel 7 and the spinning tube 15. When the yarn break occurs, the feed roll 5 is stopped in its rotation. Then, a brake rod 18 is depressed by the operator or by an automatic joining device which is shown schematically at 17 and which is designed to travel along a rail 16 for detecting the yarn break and automatically joining the broken yarn. A brake lever 19 connected to the lower end of the brake rod 18 is now swung clockwise about its pivot. This brake lever 19 is associated with a brake shoe 21 by way of an intermediate lever 23, a rod 25 and a disconnecting lever 24. Thus when the brake lever 19 is rotated clockwise, it acts on the intermediate lever 23 by its end roller 20 and thus applies the brake lever 21 to the rotor shaft, at the same time that the brake lever 19 acts on the changeover valve 22. A preferred arrangement is such that the changeover valve 22 is actuated precisely at such a time that the rotor shaft 13 starts to be operated by the brake shoe 21.

The end roller 20 of the brake lever 19 is engaged with the one end of which is connected to a rod 25 associated with the disconnecting lever 24. Thus, the disconnecting lever 24 is swung upon clockwise partial rotation of the brake lever 19. The disconnecting lever is biased in one direction permanently by the coil spring 27 about pivot shaft 26. The tension pulley 14 mounted on the lever 24 at the side of the coil spring 27 is urged permanently into pressure engagement with the belt 12 which is thereby pressed onto the rotor shaft 13. At this time, the brake shoe 21 is disengaged from the rotor shaft 13. Thus when the brake lever 19 is rotated partially clockwise by operation of the brake rod 18, the brake shoe is applied to the rotor shaft 13 under extending the coil spring 27, the tension pulley then disengaging from the rotor shaft 13.

The stroke of rotation of the brake lever 19 is from the position shown in FIG. 4 to a position in which the brake lever 19 abuts on a fixed pin stopper 28 mounted to some stationary portion of the machine frame. The stopper pin 28 may be mounted for cooperating with any other lever of the link system from the rod 18 to the lever 24. The changeover valve 22 is mounted to some stationary portion of the machine frame and in such a way that an operating member 29 of the valve 22 is positioned within the range of rotation of the brake lever 19. The changeover valve 22 is mounted adjustably as shown in FIG. 5 with set screws or the like fastening means which may be mounted in any desired position in two vertical slots 30 provided in the machine frame. By such arrangement, the operating piece 29 can be mounted selectively at an optimum position with respect to the brake lever 19 such that the compressed air may be supplied at a desired period of time in the course of brake application to the rotor shaft. A delivery passage 31 connecting to an air compressor, not shown, is turned on and off by the operation of this changeover valve 22 for starting or terminating the supply of compressed air into the rotor 1 by way of an jet orifice 32 provided in a cover member of the rotor 1. According to the present embodiment, only one jet orifice 32 is provided in the cover member, but the remaining fiber or dust and dirt can be discharged from the rotor owing to slow rotation of the rotor 1. Since the rotor 1 is mounted in a closed chamber 34 scaled by packings 33 from the machine frame, the foreign matter discharged from the rotor 1 into the chamber 34 may be transported towards a suction device, not shown, through a discharge duct 35. When joining the yarn, the finger pressure or the pressure exerted by an actuating member of the automatic yarn joining device is released from the brake rod. Then the supply of compressed air into the rotor may be terminated automatically and in timed relation with the brake application to the rotor 1 caused by the compression of the coil spring 27 and the resulting abutment of the brake shoe 21 on the rotor shaft 13.

Figure 7:
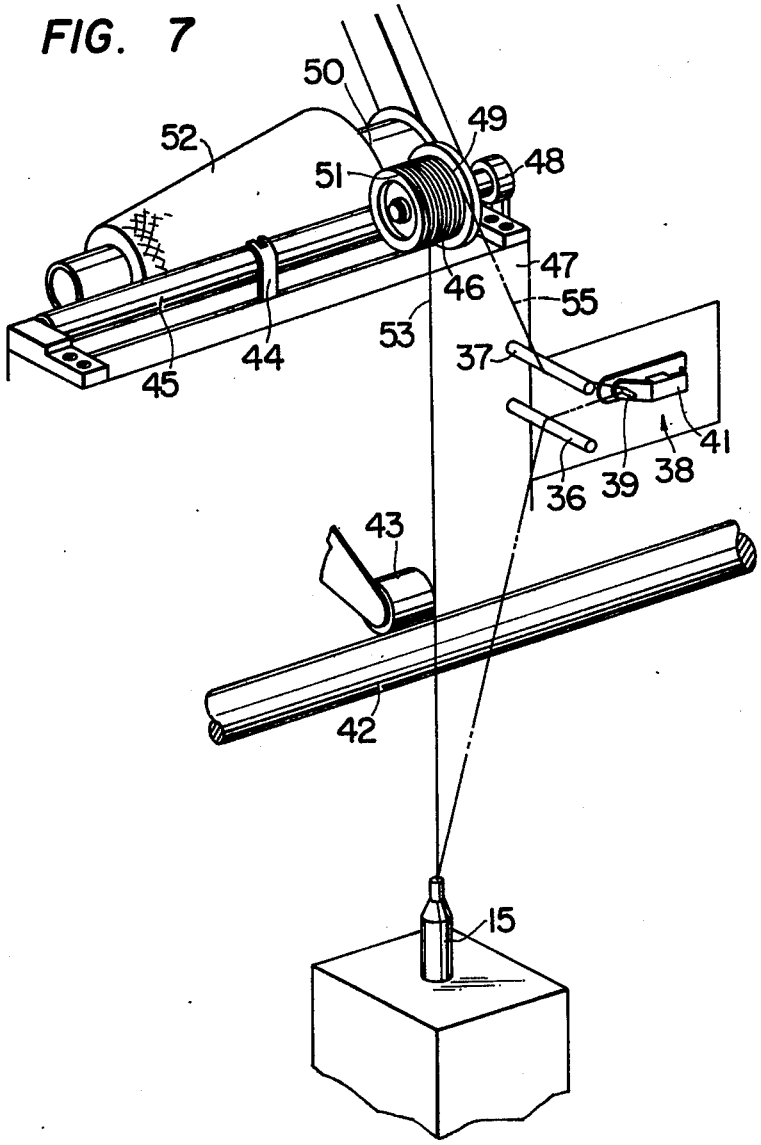
FIG. 7 is a perspective view of the yarn delivery device of the open-end spinning machine according to the present invention.
Figure 8:
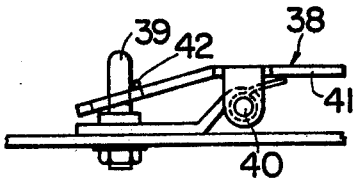
FIG. 8 is a schematic view of the yarn holding device forming a part of the yarn delivery device shown in FIG. 7.
Figure 9:
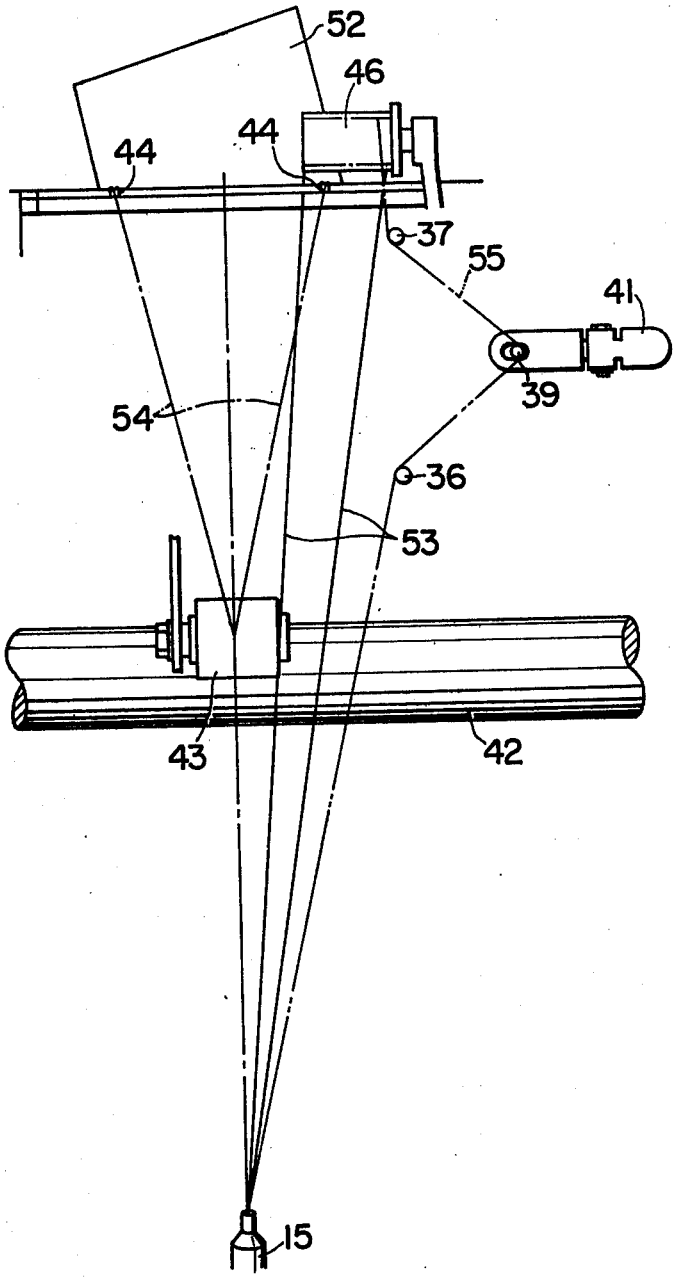
FIG. 9 is an explanatory front view of the yarn delivery device shown in FIG. 7.

The yarn delivery device used in the open-end spinning machine for delivery of the joined yarn towards the package will be described by referring to FIGS. 7, 8 and 9.

A spinning tube 15 is connected as conventionally to the navel 8 through which the twisted yarn is withdrawn from the rotor 1. The yarn deflecting device is denoted by the numerals 36, 37, 38, 39. The yarn end drawn out, from the package where the yarn break has occurred is deflected from between two guide pins 36, 37 and hooked around the projection 39 of the yarn holding device 38. The yarn end is cut at a suitable position and introduced into the spinning tube 15. The foremost part of the yarn end does not get to the inside of the rotor 1. A lever 41 forming a part of the yarn holding device is apertured for loosely rceiving the projection 39 introduced into this opening so that the lever 41 pivots freely about a pivot shaft 40 mounted to some stationary part of the machine frame. The yarn 55 is engaged about the yarn holding pin 39 as shown in FIG. 8 may thus be released upon clockwise rotation of the lever 38 about the pivot shaft 40.

Numeral 42 denotes a delivery roller which is kept permanently in rotation during the operation of the spinning machine. Numeral 43 denotes a nip roller designed to press the yarn onto the delivery roller 42 and to feed the yarn in cooperation with the delivery roller. Numeral 44 denotes a traverse guide and numeral 45 a friction roller. The traverse guide 44 and the friction roller 45 may be replaced by a traverse drum, in which case the latter may be formed as an elongated shaft arranged longitudinally of the machine base in the same manner as the delivery roller 42. Each spindle of the machine may be associated with a traverse drum and the latter may be brought into or out of operation by the latch device individual to each spindle. When a number of traverse drums are fixed on a common mounting shaft, a travelling unit may be provided so as to travel along the front sides of the spinning units of the spinning machine. This travelling unit may be provided with a speed-up roller individual to each package and may be designed to interrupt the driving connection between the package and the traverse drum which is rotated permanently in case of occurrence of yarn break. After the yarn joining, the speed-up roller of the travelling unit is engaged with the package so as to elevate the rotational sped of the package to the same speed as the traverse drum. The travelling unit operates at this time to apply the package onto the traverse drum for restarting the yarn take-up operation. In the present embodiment, the traverse guide 44 and the friction roller 45 are so constructed and arranged that the number of revolutions of the package will be increased gradually with increase in the number of revolutions of the rotor.

Numeral 46 denotes a threaded roll secured to the machine frame at 47 by a bracket 48. The roll 46 is mounted so as to rotate freely about its axis substantially parallel to that of the friction roll 45. The axis of the threaded roll 46 may also be tilted with respect to that of the friction roll 45. The roll 46 is mounted by the bracket 48 so that the end 49 secured to the bracket 48 is located to the left side of the right-hand end 50 of the yarn package formed on a wood or paper pim in order that the yarn drawn out from the yarn package 50 by way of the thread on the threaded roll 46 may always be retained by the periphery of the yarn package 50. In addition, the other end 51 of the roll 46 is so positioned that the passageway of the yarn engaged with the thread at said end 51 of the roll 46 and introduced into the spinning tube 50 is located tangentially to the right-hand end face of the permenently rotating nip roll 43 when seen in FIG. 9, in order that the yarn so far guided along the thread of the roll 46 may be caught by and between the nip roll 43 and the delivery roll 42 as soon as it is disengaged from the thread on the thread roll 46. The thread roll 46 must also be positioned relatively to the traverse guide 44 so that the yarn 55 is not engaged with the traverse guide 44 at all while the yarn 55 is engaged with the thread of the thread roll 46.

The yarn end drawn from the yarn package 52 where the yarn breakage has occurred is engaged with the thread roll 46 and hooked around the projection 39 of the yarn holding device 38 by way of the guide pins 36, 37. The yarn end is then introduced into the spinning tube 15. The position of the yarn assumed at this stage is shown by the chain-dotted line in FIGS. 7 and 9. When the lever 41 is depressed by the operator or by an operating piece of the automatic yarn-joining device, the yarn 55 is disengaged from the projection 39 and sucked into the rotor 1 for yarn joining. The friction roll 45 is driven into rotation and accelerated gradually in correspondence with the increased number of revolutions of the rotor 1. The joined yarn 53 is taken up on the package 52 as it is guided by the thread on the threaded roll 46. As the yarn 53 arrives at the left-hand turn of the thread formed at the end 51 of the thread roll 46, as shown by the solid line in FIG. 7, the yarn 53 is clamped between the nip soll 43 and the delivery roll 42 as it is disengaged from the last turn of the thread of the roll 46. At the same time, the yarn 53 is caught by the traverse guide 44, and thus the normal or traverse takek-up operation on the yarn package 52 is started at the yarn position shown at 53.

The yarn disengaged from the threaded roll 46 is slacked suddenly since the roll 46 is mounted well above the traverse guide 44 so that the roll 46 does not interfere with the reciprocating movement of the traverse guide. However, the yarn is caught by the nip roll 43 before the tension of the yarn disposed in the spinning tube 15 is affected adversely by the slack in the yarn tension at the side of the thread roll 46. Thus, the yarn disposed in the rotor is not affected by the change in the yarn tension caused by the disengagement of the yarn from the thread roll, and there is no fear that the yarn may break again or be deteriorated in quality.

It will be appreciated from the above that the yarn can be delivered to the yarn package after the completion of the yarn joining resulting in the manufacture of high-quality spun yarn.

What is claimed is:

1. A yarn piecing method for joining end yarn which is fibers supplied into a rotor by means of a feed roll with yarn drawn from a yarn package in an open-end spinning machine including a rotor, rotor brake and a feed roll feeding fiber sliver to an opening roll, comprising braking the rotor prior to yarn joining while the feed roll is rotated for some short period of time after braking the rotor for supplying fiber into the rotor, removing the fiber thus supplied from inside of the rotor together with the dust and dirt collected in the rotor, then releasing the brake for accelerating the rotor, starting the rotation of the feed roll when the rotor has reached a number of revolutions adequate for yarn joining to again supply fiber to the rotor, injecting the yarn drawn from the yarn package into the rotor and joining the end yarn with the yarn drawn from the yarn package, starting the take-up operation and accelerating the rotation of the yarn package to the normal take-up speed.

2. The yarn piecing method as claimed in claim 1 wherein the removal of the fiber with the dust and dirt from the inside of the rotor is effected by supplying a jet of compressed air into the rotor during the low speed rotation of the rotor.

3. The yarn piecing method as claimed in claim 1 wherein a traverse guide and delivery device are operably associated with the spinning machine and the yarn is caught by the traverse guide and the delivery device when the rotor and the yarn package have reached the normal yarn take-up speed.

* * * * *

Disclaimer 4,022,011.—*Hironori Hirai,* Nagaokakyoshi, Kyoto, Japan. YARN PIECING METHOD FOR OPEN-END SPINNING MACHINE. Patent dated May 10, 1977. Disclaimer filed Dec. 24, 1984, by the assignee, *Spindelfabrik Suessen-Schun, Stahlecker & Grill G.m.b.H.*

The term of this patent subsequent to Oct. 17, 1984, has been disclaimed.

[*Official Gazette September 24, 1985.*]